United States Patent [19]

Nelson

[11] Patent Number: 4,666,399

[45] Date of Patent: May 19, 1987

[54] LOW PRESSURE GAS TORCH BURNER

[75] Inventor: John M. Nelson, Brockport, N.Y.

[73] Assignee: Newell Companies, Inc., Freeport, Ill.

[21] Appl. No.: 840,325

[22] Filed: Mar. 14, 1986

[51] Int. Cl.[4] ..... F23Q 3/00

[52] U.S. Cl. ..... 431/264; 431/344; 431/353

[58] Field of Search ..... 431/255, 264, 266, 344, 431/345, 349, 353, 254, 258, 256; 239/399

[56] References Cited

U.S. PATENT DOCUMENTS

| | | | |
|---|---|---|---|
| 1,867,934 | 7/1932 | Zahner | 431/265 |
| 3,806,038 | 4/1974 | Nelson | 431/349 |
| 4,013,395 | 3/1977 | Wormser | 431/353 X |
| 4,348,172 | 9/1982 | Miller | 431/255 |
| 4,526,532 | 7/1985 | Nelson | 431/255 |

*Primary Examiner*—Margaret A. Focarino

*Attorney, Agent, or Firm*—Donald C. Studley; Michael L. Dunn

[57] ABSTRACT

A portable, low-pressure propane gas torch including an internal spark igniter is characterized by the absence of the heretofore conventional venturi. Particular ratios of the inside diameters of the orifice member outlet and the burner tube provide an optimum mixture of flammable gas and aspirated air.

10 Claims, 6 Drawing Figures

LOW PRESSURE GAS TORCH BURNER

This invention relates to a portable, low-pressure propane gas torch which is provided with a built-in spark igniter located within the burner tube and, more particularly, relates to a gas torch characterized by the presence of the internal spark igniter and the absence of the heretofore conventional venturi.

Further, the invention is related to novel subject matter disclosed in a copending application Ser. No. 839,901 filed on even date herewith by the same inventor and entitled "Spark Igniter System", the description of which is incorporated herein by reference.

BACKGROUND OF THE PRIOR ART

Propane gas torches are well known and disclosed in a number of patents. Examples of known gas torches are disclosed in U.S. Pat. Nos. 3,663,154 (J. K. Locke), 3,768,962 (F. Baranowski, Jr.) and 4,013,395 (A. F. Wormser). Each of these gas torches is provided with a venturi for introducing air into the combustible mixture; the use of a venturi adds to the cost of manufacture and assembly. Also, these torches are not provided with internal igniters.

Patented gas torches which are provided with spark igniters, but are also provided with a venturi, are exemplified by U.S. Pat. Nos. 4,348,172 (H. C. Miller) and 4,526,532 (J. M. Nelson).

An example of a prior art gas torch which does not require a venturi, but also is not provided with a built-in igniter, is exemplified by U.S. Pat. No. 3,806,038 (J. M. Nelson).

BRIEF SUMMARY OF THE INVENTION

The invention provides a low-pressure gas torch which is particularly characterized by the provision of an internal spark igniter located within the burner tube and operates without the heretofore conventional venturi.

A principal object of the invention is to provide a low-pressure gas torch comprising a burner tube, means for introducing a combustible mixture of flammable gas into the burner tube, spark igniter means disposed within the burner tube for igniting the flammable gas therein, the burner tube having an entrance portion and a passageway for the mixture, the passageway having a substantially constant cross-sectional area along its length for providing unimpeded flow of the mixture through the burner tube from the entrance portion to the spark igniter means.

A further object of the invention is to provide such a torch which includes an orifice member located at the entrance portion of the burner tube for supplying a jet of flammable gas into the passageway, and openings in the periphery of the burner tube at the entrance portion for providing a flow of ambient air for mixing with the flammable gas.

A further object of the invention is the provision of such a torch wherein the spark igniter means comprises an electrically conductive wire and a fastener clip for securing the wire within the burner tube, the wire being disposed within the burner tube and extending along the interior thereof.

Another object of the invention is to provide such a torch which includes a flameholder secured within the burner tube and spaced from the spark igniter means on a side thereof remote from the entrance portion.

Another object of the invention is the provision of such a torch wherein the orifice member has a gas outlet disposed on a central axis thereof and located in alignment with a central axis of the burner tube, the burner tube and the gas outlet having inside diameters ranging from a ratio of 20 to 1 up to a ratio of 60 to 1.

A still further object of the invention is the provision of such a torch wherein the inside diameter of the burner tube is about 37 times the inside diameter of the gas outlet in the orifice member, and even more particularly, the provision wherein the inside diameter of the burner tube is about 0.335 inch and the inside diameter of the gas outlet is about 0.0091 inch.

DETAILED DESCRIPTION OF THE INVENTION

Figure 1:
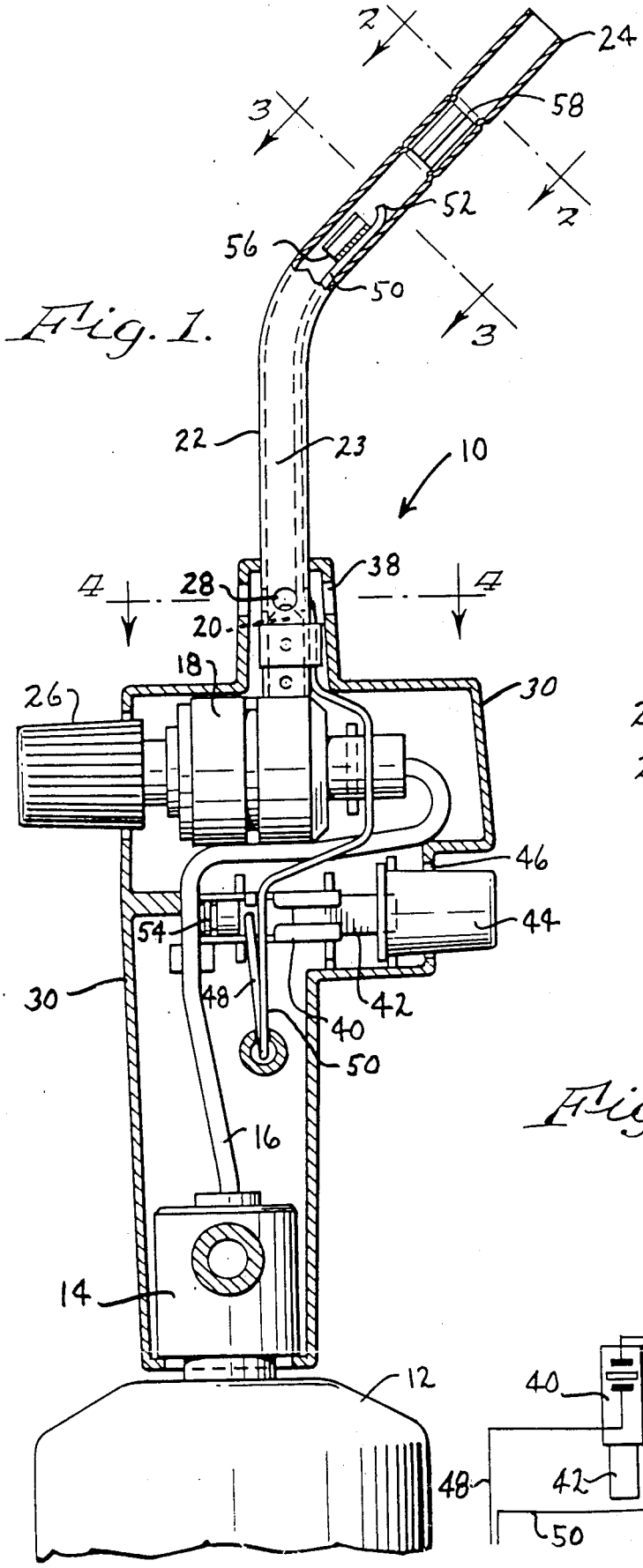
FIG. 1 is a sectional elevation of a gas torch with portions partly broken away to better illustrate the present invention.

Referring to the drawing in detail, a preferred embodiment of the invention is depicted as being incorporated in a low-pressure propane gas torch, generally indicated by the numeral 10, which is shown as being connected to a conventional gas cartridge 12 by means of an internally threaded coupling 14. Gas cartridge 12 is old and well known, and are available from Bernzomatic Corporation, Medina, N.Y., and designated by Stock No. TX-9 or TX-9C. Gas cartridge 12 contains pressurized propane or the like with typical pressures being about 110 psig.

Figure 4:
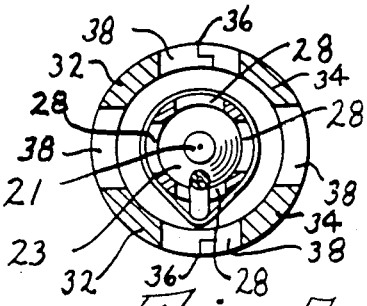
FIG. 4 is a sectional view, taken on line 4—4 of FIG. 1 and illustrates an orifice member having a gas outlet therein located at an entrance portion of the burner tube.
Figure 5:
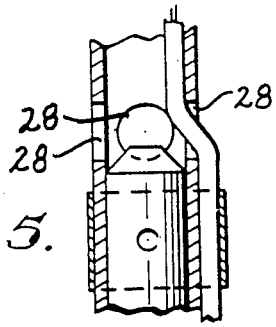
FIG. 5 is an enlarged fragmentary view illustrating the orifice member at the entrance portion of the burner tube and shows the manner of placing the igniter wire into the burner tube.
Figure 6:
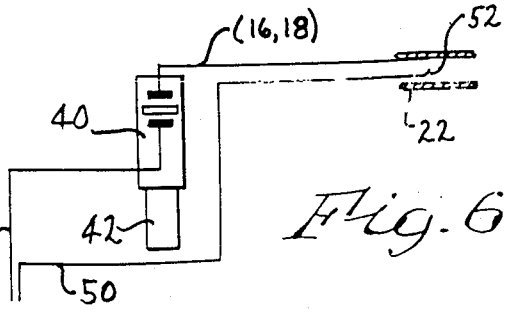
FIG. 6 is a schematic view of a piezoelectric circuit for creating a spark gap for the igniter.

A fuel supply line 16 carries pressurized gas from cartridge 12 to a conventional pressure regulator 18 which reduces the pressure to a range of about 27 to 31 psig. Gas under pressure exits from regulator 18 through an orifice member 20 which is in axial alignment with a burner member or tube 22 and passes through the tube 22 and out from a burner tip 24. A rotatable adjustment knob 26 is movable from an "off" position to a "open" position for controlling the flow of flammable gas out of regulator 18 and orifice member 20. It is to be noted with particularity that orifice member 20 is provided with a centrally located, longitudinally extending, quite small gas outlet 21, as is best shown in FIG. 4, the gas outlet 21 having a preferred inside diameter of about 0.0091 inch (0.23 mm).

An entrance portion of burner tube 22 is defined by the location of gas outlet 21, of orifice member 20, and a plurality of openings 28, usually four in number, equally spaced about the periphery of burner tube 22 for allowing ambient air to be aspirated into tube 22 as a jet of gas under pressure is emitted from orifice member 20 through gas outlet 21. The gas mixes with the air while flowing through a passageway 23 which has a substantially constant cross-sectional area.

Torch 10 is provided with a molded cover or case 30 for enclosing various portions of the device. Case 30 is preferably molded of thermoplastic material such as cycolac, ABS resin or the like. Case 30 is preferably molded of two generally similar, separate mating halves 32 and 34 which may be joined together along a central dividing line 36 by ultrasonic welding or the like, as best illustrated in FIG. 4 (it should be noted that FIG. 4 has been rotated 90° in the plane 4—4 of FIG. 1). Case 30 includes various openings therein to provide access to threaded coupling 14, protrusion of adjustment knob 26 and an aperture for burner tube 22. In addition, case 30 includes a series of air vents 38, usually four in number, which are in alignment with openings 28 in the periphery of burner tube 22 at the entrance portion thereof as is best shown in FIGS. 1 and 4.

Torch 10 is actuated by an internal spark igniter circuit which is the subject matter of my copending application Ser. No. 839,901 entitled "Spark Igniter System" referred to above. It will be understood that the spark igniter circuit includes a piezoelectric igniter 40 having a spring-loaded plunger 42 which is operated by squeezing a trigger 44 into the case 30 through an opening 46. Igniter 40 is known in the prior art as is exemplified by the above-mentioned U.S. Pat. Nos. 4,348,172 and 4,526,532. A particularly useful igniter 40 is designated as RION MODEL TS-95S 063 and is available from Universal Trading Company, 4-4 Yayoi, 2-chome, Bunkyo-ku, Tokyo, Japan. Igniter 40 provides a voltage in the range of about 12 to 17 kilovolts and sends an electric current through a first conductor 48 and through a second conductor 50 to generate a spark in burner tube 22 at a free end 52 of second conductor 50. When the spark jumps across the spark gap between free end 52 and the burner tube 22, the current returns to igniter 40 through the burner tube 22, regulator 18, fuel supply line 16 and a base 54, all of which are made of metal and form a continuous electrically conductive path.

Figure 2:
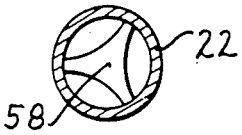
FIG. 2 is a sectional view, taken on line 2—2 of FIG. 1 and illustrates a conventional flameholder disposed within the burner tube near the exit end thereof.
Figure 3:
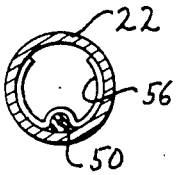
FIG. 3 is a sectional view, taken on line 3—3 of FIG. 1 and illustrates an attachment clip for securely positioning an igniter wire to provide a desired spark gap.

From the foregoing description, it will be understood that adjustment knob 26 is rotated to an open position to allow flammable gas to flow from cartridge 12 through fuel supply line 16 to the regulator 18, and outwardly through the gas outlet 21 in orifice member 20. The gas flowing from outlet 21 is directed along the longitudinal axial center of burner tube 22 and causes ambient air to be aspirated into tube 22 through the air vents 38 and openings 28. The air and gas mix during passage through the passageway 23; the cross-sectional area of burner tube 22, minus the cross-sectional area of conductor 50 provides a constant cross-sectional area for passageway 23 from openings 28 to a fastener clip 56. The combustible mixture is ignited by a spark at free end 52 upon actuation of the trigger 44. Conductor 50 is fixedly located by means of fastener clip 56 just upstream from a conventional flameholder 58 which is best shown in FIGS. 1 and 2.

As previously mentioned above, it is preferred that gas outlet 21, in orifice member 20, has an inside diameter of about 0.0091 inch (0.023 mm). Dimensions of burner tube 22 are also of critical importance to the invention. The inside diameter of tube 22 is preferably about 0.335 inch and thus is about 37 times the inside diameter of gas outlet 21. A ratio of inside diameters might range from a ratio of 20 to 1 up to a ratio of 60 to 1 but the preferred ratio is 37 to 1. These dimensions are not to be taken lightly; the unexpected discovery that the costly venturi could be eliminated from a low-pressure gas torch is directly related to these dimensions. Burner tube 22 can not be much smaller than 0.335 inch because it would then be too small to produce a sufficient spark gap at free end 52 of the conductor 50. If the burner tube is considerably larger than the preferred diameter, flashback will occur in the tube and it will be difficult to obtain the proper air-gas mixture.

It is to be understood that the disclosed low-pressure gas torch burner is useful in other environments such as gas operated lanterns, stoves and the like, and that various modifications and changes may be made without departing from the spirit and scope of the invention as defined in the following claimed subject matter.

What is claimed is:

1. A low pressure gas torch comprising a burner tube, means for introducing a combustible mixture of flammable gas into said burner tube, comprised of an orifice member located at the entrance portion of said burner tube for supplying a jet of flammable gas therein, and openings in the periphery of said burner tube at said entrance portion for providing a flow of ambient air for mixing with said flammable gas, a spark igniter means disposed within said burner tube for igniting said combustible mixture therein, said burner tube providing a passageway for said mixture, said passageway having a substantially constant cross-sectional area along its length for providing unimpeded flow of said mixture through said burner from said entrance portion to a spark gap portion of said spark igniter means, the inside diameter of said burner tube and the diameter of the opening in said orifice member having a ratio of from 20 to 1 up to a ratio of 60 to 1.

2. A torch as defined in claim 1 wherein said spark igniter means comprises an electrically conductive wire and a fastener clip for securing said wire within said burner tube, said wire being disposed within said burner tube and extending along the interior thereof.

3. A torch as defined in claim 2 including a flameholder secured within said burner tube and spaced from said spark igniter means on a side thereof remote from said entrance portion.

4. A torch as defined in claim 3 including an orifice member located at said entrance portion of said burner tube for supplying a jet of flammable gas into said passageway, and openings in the periphery of said burner tube at said entrance portion for providing a flow of ambient air for mixing with said flammable gas.

5. A torch as defined in claim 4 wherein said orifice member has a gas outlet disposed on a central axis thereof and located in alignment with a central axis of said burner tube, said burner tube and said gas outlet having inside diameters ranging from a ratio of 20 to 1 up to a ratio of 60 to 1.

6. A torch as defined in claim 5 wherein the inside diameter of said burner tube is about 37 times the inside diameter of said gas outlet in said orifice member.

7. A torch as defined in claim 6 wherein the inside diameter of said burner tube is about 0.335 inch and the inside diameter of said gas outlet is about 0.0091 inch.

8. A torch as defined in claim 1 wherein said orifice member has a gas outlet disposed on a central axis thereof and located in alignment with a central axis of said burner tube, said burner tube and said gas outlet having inside diameters ranging from a ratio of 20 to 1 up to a ratio of 60 to 1.

9. A torch as defined in claim 8 wherein the inside diameter of said burner tube is about 37 times the inside diameter of said gas outlet in said orifice member.

10. A torch as defined in claim 9 wherein the inside diameter of said burner tube is about 0.335 inch and the inside diameter of said gas outlet is about 0.0091.

* * * * *